United States Patent [19]

Johnson

[11] 4,029,251

[45] June 14, 1977

[54] ROLL FEED WITH MODULAR ROLL LIFTER MECHANISM

[75] Inventor: Kenneth C. Johnson, Des Plaines, Ill.

[73] Assignee: F. J. Littell Machine Company, Chicago, Ill.

[22] Filed: Mar. 15, 1976

[21] Appl. No.: 667,134

[52] U.S. Cl. ..... 226/154; 226/176; 226/181

[51] Int. Cl.[2] ..... B65H 17/22

[58] Field of Search ..... 226/154, 155, 176, 177, 226/181, 186

[56] References Cited

UNITED STATES PATENTS

| | | | |
|---|---|---|---|
| 3,758,011 | 9/1973 | Portmann | 226/154 X |
| 3,907,188 | 9/1975 | Peterson | 226/154 |

*Primary Examiner*—Richard A. Schacher
*Attorney, Agent, or Firm*—Russell H. Clark

[57] ABSTRACT

In the strip feeding apparatus of the invention, the strip material passes between a lower driven roll and an upper idler roll which is mounted on a vertically slidable adjusting plate so as to move in a pivotal manner towards and from the lower driven roll. The idler roll is mounted on the adjusting plate by means of a pivotal bracket, whereby the idler roll and its bracket can be adjusted bodily in a vertical direction to and from the lower driven roll without disturbing the action of the pressure means forcing the idler roll towards the driven roll and without disturbing the action or timing of the actuating cam which periodically produces a lifting of the idler roll against the pressure of the pressure means.

5 Claims, 5 Drawing Figures

Figure 3:
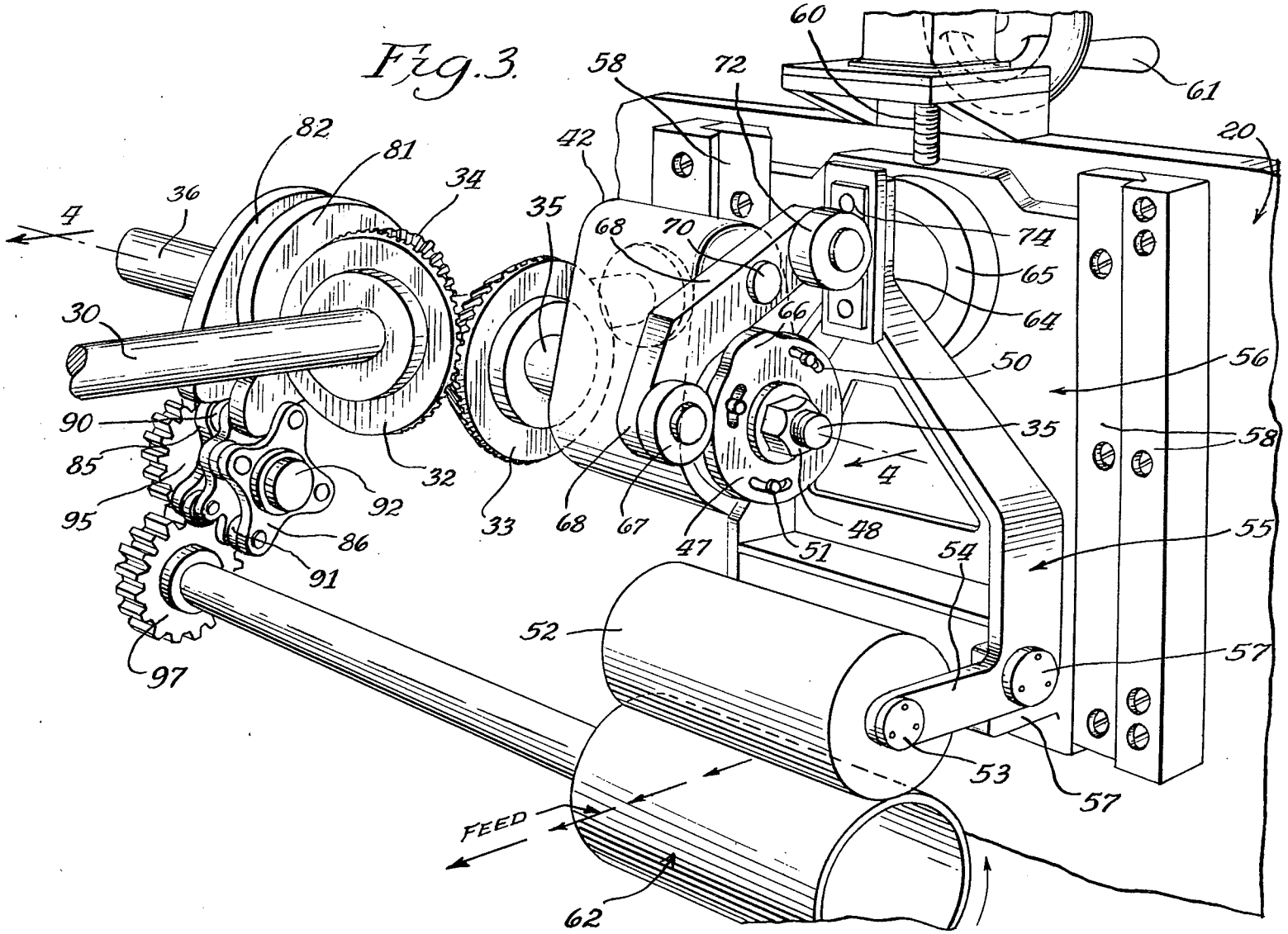

Fig. 1
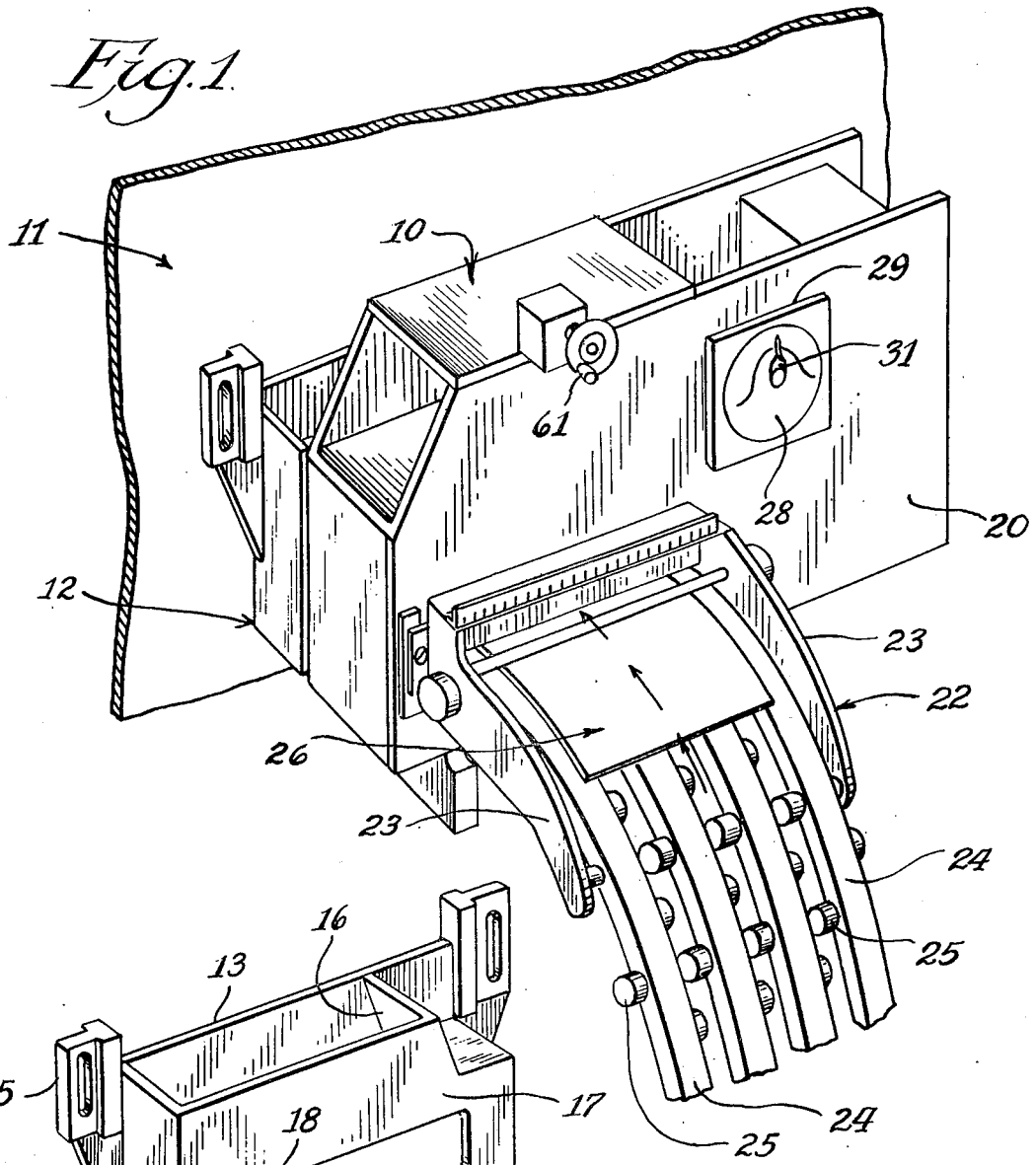
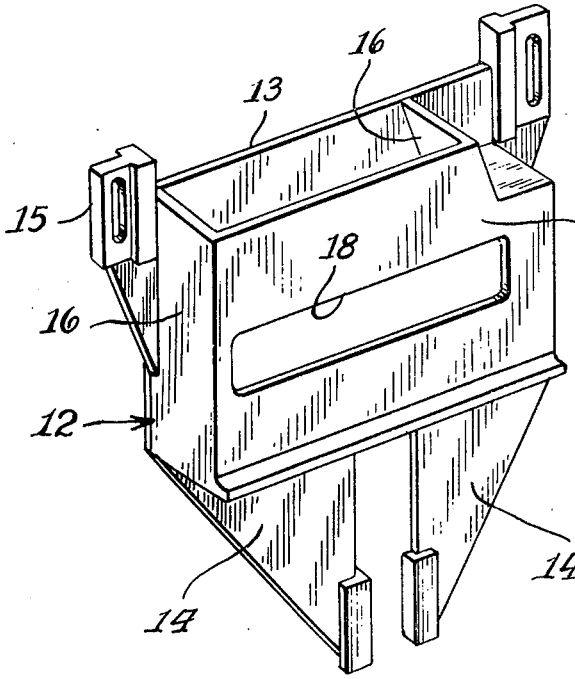
Fig. 2.

76
82
81
38
39
89
78
83
84
95
94
77
96
92
97
101
77
76
91
86
98
90
92
94
85
38
37
39
34
36
40
80
32
30
33
41
42
71
70
68
35
43
44
47
46
45
48
52
57
98
63
100
103
102
62

ROLL FEED WITH MODULAR ROLL LIFTER MECHANISM

The invention relates to improved roll feeding mechanism for intermittently feeding strip material in desired lengths to a forming press, punch press or similar machine and has reference in particular to novel and improved roll lifter mechanism for periodically lifting the idler roll from the gear driven feed roll whereby to release the strip material located between the rolls following a feeding operation.

It is conventional in the art of feeding strip material such as tin plate, aluminum and other metals and also plastics, for the strip to be fed by a pair of rolls known as a feeding couple and including a lower gear driven roll and an upper idler roll. The material is fed to the reciprocating die of a press, such as a forming or punch press, in an intermittent manner and the idler roll is resiliently forced in a contacting direction towards the lower driven roll to form the bite which results in an accurate advance or feeding of the strip material by eliminating slippage.

The main objective of the invention is to provide novel and improved lifter mechanism for the idler roll which will be modular in character embodying component parts including the actuating cam for lifting the roll and wherein said parts can be easily removed and replaced with similar parts but having different characteristics.

Another object of the invention resides in the provision of idler roll lifter mechanism wherein the idler roll is mounted for pivotal movement on a vertically slidable adjusting plate, the said plate mounting a pivotal bracket supporting the idler roll for movement and also including an air bag located on the plate, whereby the idler roll can be adjusted bodily in a vertical direction to and from the lower driven roll without disturbing the action of the air bag in biasing the idler roll towards the lower roll, and without disturbing the action or timing of the actuating cam which periodically produces a lifting of the idler roll against the pressure of the air bag.

Another object is to provide gear housing means for the incoming drive from the press and which will house an arrangement of bevel gears for rotating secondary shafts, respectively, and which extend horizontally in opposite directions, one secondary shaft providing the drive to the lower feed roll and the other shaft having actuating cam means thereon for producing the lifting and releasing action of the upper lifter roll, said actuating cam means being angularly adjustable and repleaceable for controlling the timing and duration of the lifting actions.

A further objective of the invention is to provide idler roll lifter mechanism as described which will incorporate a secondary drive shaft having novel and improved means for releasably and adjustably mounting an actuating cam on the terminal end of the shaft, whereby the actuating cam is exchangeable for other cams with alternate profiles, or for split cams for extending the duration of the lift and also the types of lifts.

Still another objective is to provide roll lifter mechanism incorporating a slidable adjusting plate for supporting certain parts of the mechanism and whereby the idler roll is capable of pivotal movement for periodic lifting actions in addition to vertical bodily movement in a manner precisely parallel to the lower feed roll.

With these and other objects in view, the invention may consist of certain novel features of construction and operation as will be more fully described and particularly pointed put in the specification, drawings and claims appended thereto.

Figure 4:
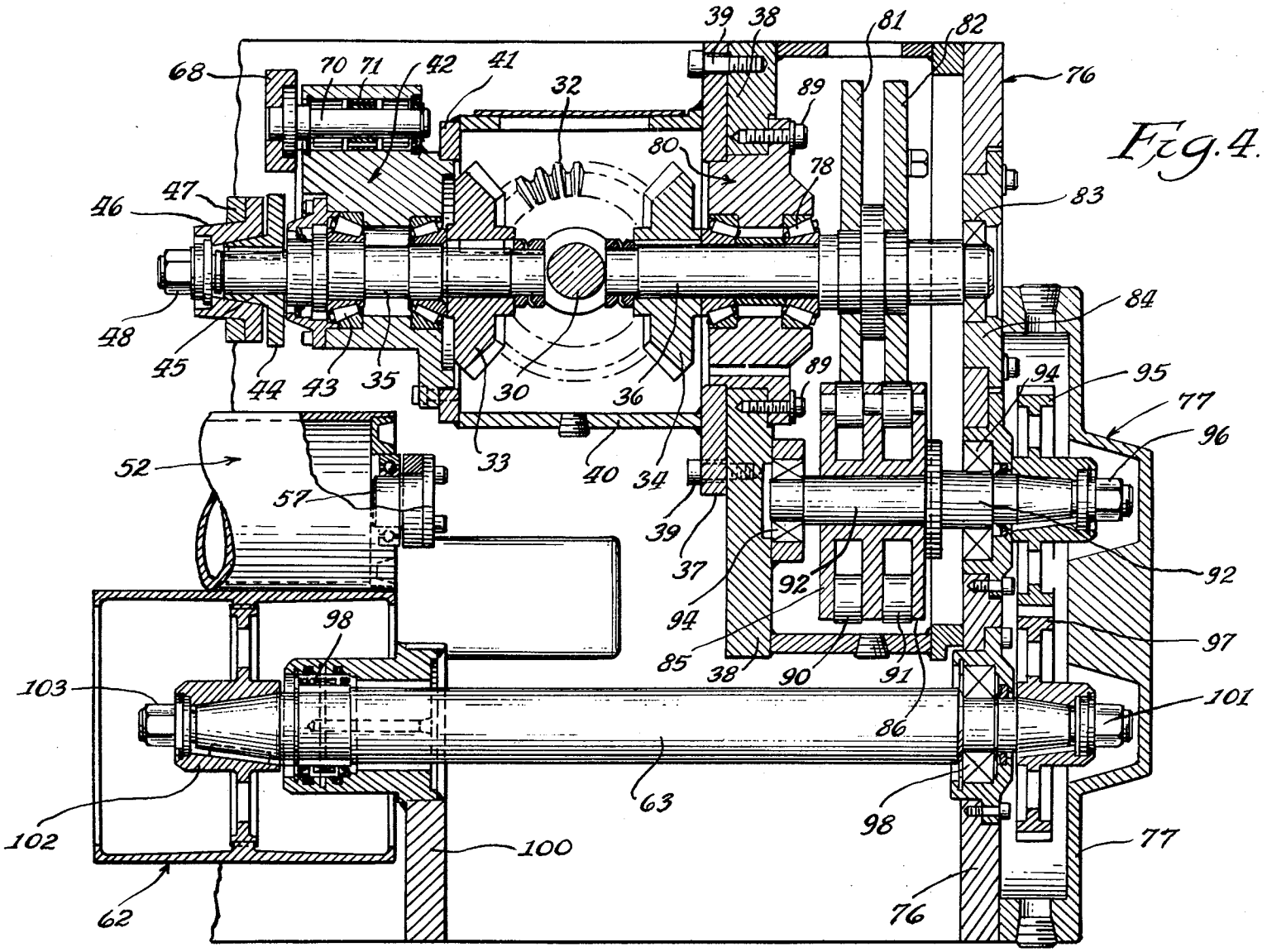
Figure 5:
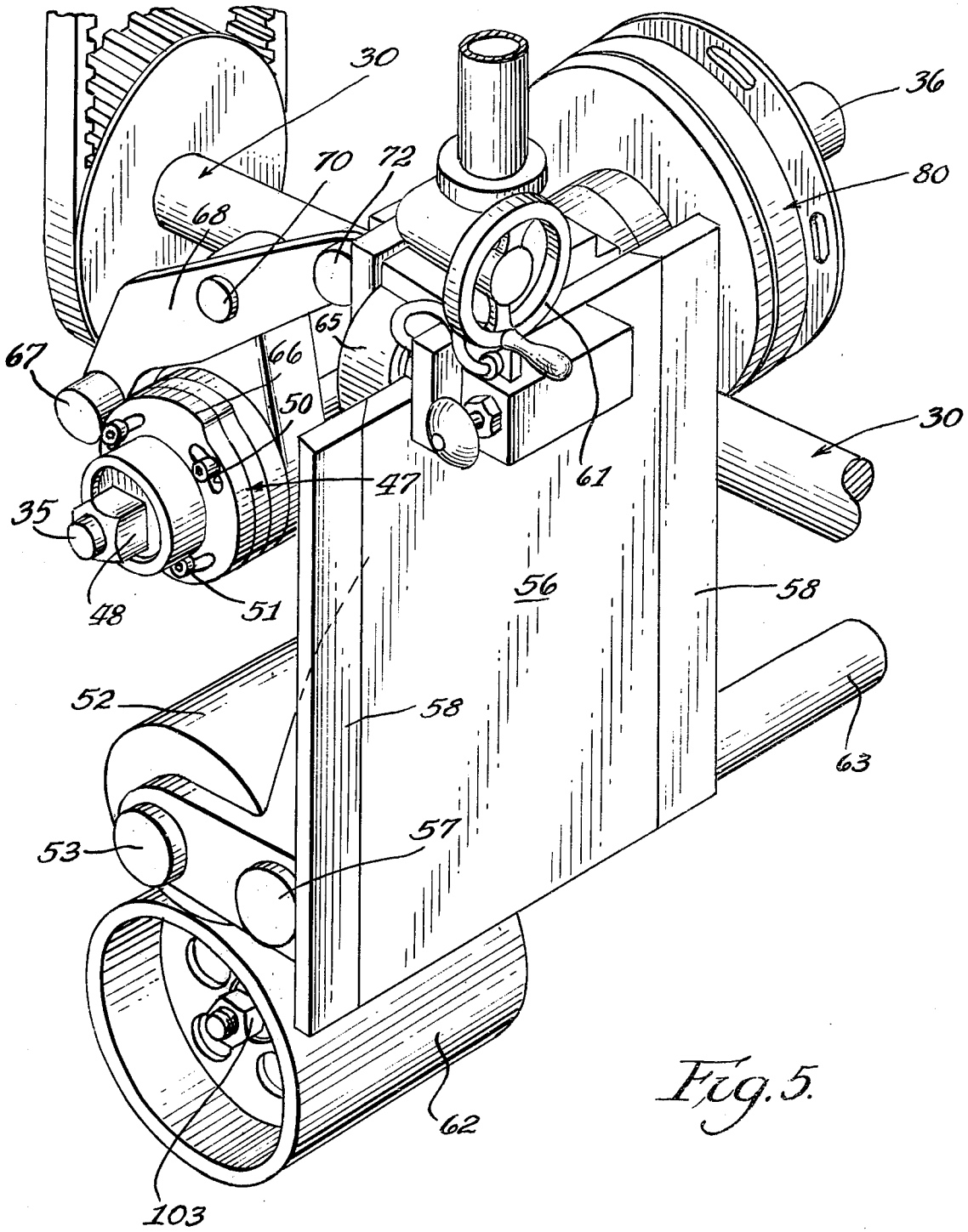

In the drawings which illustrate an embodiment of the apparatus and wherein like reference characters are used to designate like parts, FIG. 1 is a perspective view of the front entrance side of the strip feeding apparatus constructed in accordance with and embodying the improved features of the present invention, FIG. 2 is a front perspective view of the bracket for attaching the strip feeding apparatus of FIG. 1 to a press, FIG. 3 is a perspective view showing the rear or exit side of the present strip feeding apparatus and which illustrates the bevel gear arrangement in the drive to the secondary shafts, the conjugate cams and their cam follower units, the gear drive to the lower feed roll and the cam actuated idler roll lifter mechanism, FIG. 4 is a sectional view taken vertically through the strip feeding apparatus of FIG. 3 substantially on line 4—4 and which clearly shows the cam bearing cartridge retainer and the end bearing retainer for journalling the cam driven shaft in the cam housing, and FIG. 5 is a perspective view of the rear side of the lifter roll adjusting plate showing the side gibs for slidably mounting the same and also showing associated structure in coacting relation therewith.

FIG. 1 of the drawings shows the strip feeding apparatus of the invention, designated by numeral 10, applied to the entrance side of a press 11 by means of the bracket 12 best shown in FIG. 2. The rear wall 13 of the bracket includes the depending web portion 14 and the side extending slotted areas 15. The box shaped enclosure to which the strip feeding apparatus is directly secured, has side walls 16 and a front wall 17 and the enclosure is integral with the rear wall 13 of the bracket. The strip feeding apparatus 10 is suitably secured to the bracket and the bracket is in turn secured to the rear wall 11 of the press with the elongated openings 18 in both the front wall 20 of the apparatus and wall 17 of the bracket in proper horizontal alignment with the die of the press all as clearly understood in the art.

The entrance apron for the strip material, shown in FIG. 1 and designated by numeral 22, projects from the front wall 20 and the same includes the side arms 23 and the depending arcuate members 24 having the rollers 25 thereon. The strip material 26 may ride on the rollers as it is being fed through the openings 18 on its way to the press. The front wall 20 of the strip feeding apparatus also has the timing dial 28 fixed thereto and which is enclosed by the transparent guard 29. The terminal end of the main drive shaft 30, see FIGS. 3 and 4, has the indicator 31 fixed thereto and which compliments the indica on the timing dial to show the operator the action of the feed rolls in advancing the strip material intermittently.

Shaft 30 is preferably rotated directly by the press and in synchronism therewith and said shaft extends into a gear box as best shown in FIG. 4, where the bevel gear 32 on shaft 30 has meshing relation with the bevel gears 33 and 34 fixed to the secondary drive shafts 35 and 36 respectively. The gear box includes the side wall 37 which is secured in adjusted position to wall 38 of the cam housing by the screws 39. The upper and lower walls of the gear box, namely 40, are suitably fixed to wall 37 and they in turn are fixed to the side wall 41 located left of the gear 33. Wall 41 has the journalling hub 42 suitably secured thereto. It will be observed that the secondary shaft 35 is journalled for rotation in hub portion 42 by the bearing unit 43 having tapered bearings and that said shaft 35 extends beyond the hub portion to receive the cam retaining member 44. Said member is keyed on shaft 35 and has a forward extending conical nose 45 on which the cam member 46 is mounted. The replaceable and adjustable actuating cam 47 of the invention is in turn mounted on the cam member 46 and the said member is secured to shaft 35 by the threaded nut 48. As best shown in FIGS. 3 and 5, the replaceable and adjustable cam 47 has a number of arcuate slots 50 which receive the headed screws 51 having threaded relation in the cam member 46. Thus the actuating cam 47 is securely held in desired position on the drive shaft 35.

The cam 47 is the actuating cam for the upper idler roll 52 journalled at 53 in the arms 54 of a lifter bracket 55. The bracket is in turn mounted for pivotal movement on the vertically slidable lifter roll adjusting plate 56. The bracket is capable of pivotal movement on a horizontal axis generally provided by members 57. The supporting members 57 for the bracket are fixedly secured to the adjusting plate 56 which is mounted for slidable movement on the rear side of front plate 20, being supported for such slidable movement by the gibs 58. The jack screw 60 and the hand wheel 61 are available to the operator for moving the adjusting plate 56 up and down so that the lifter roll 52 can be precisely positioned with respect to the lower feed roll 62 fixed to and driven by the drive shaft 63. The lifter roll 52 is yieldingly forced in a direction towards the lower feed roll 62 so as to grip the strip material located between the rolls. In accordance with the invention the bracket 55 has an upward vertically extending portion 64 which engages the air bag 65 in fixed supported position on the adjusting plate 56. The action of the air bag is to force the part 64 of the bracket outwardly and thus the lifter roll 52 is yieldingly forced downwardly towards lower roll 62.

The bite on the strip material between the feeding rolls is maintained during the feeding operation when the lower roll 62 is being rotated. However, when the rolls are stationary it is necessary to lift the upper idler roll 52 to release the grip on the strip material and this lifting action on the upper roll is effected by the actuating cam 47. The said cam has a high portion 66 adapted to contact the roller 67 during each revolution of the cam and thus the driving shaft 35. Roller 67 is mounted for rotation on a stud shaft carried by the pivot arm 68 which is pivotally supported by the shaft 70 journalled for pivotal movement by the bearing unit 71 having location in the hub portion 42, FIG. 4.

The terminal upper end of the pivot arm 68 carries the roller 72 which is in contact with the wear plate 74 on the upper part 64 of the bracket 55. The pressure of the air bag 65 forces the portion 64 and the wear plate 74 outwardly so that the wear plate is held in contact with the roller 72. This in turn urges the pivot arm in a counter-clokwise direction and the roller 67 is likewise held in contact with the actuating cam 47. During each revolution of the main drive shaft 30, the feed rolls 52 and 62 will rotate for a major portion of the same and then remain at rest for a minor portion of each revolution or vice versa. Immediately following the rotating action of the feed rolls, the high portion 66 of the actuating cam 47 will be caused to contact roller 67 and rock the pivot arm clockwise against the pressure of the air bag and thus the bracket 55 is rocked to lift the upper roll 52. The roll will be held lifted for a time period determined by the angualr extent of the high portion 66.

Since the lifter roll adjusting plate 56 carries the bracket 55 which journals the idler roll 52, it will be seen that the operator can move the adjusting plate, which is slidable in the gibs 58, and thus move said idler roll up and down in exact parallelism to the lower feed roll 62. This adjustment of the idler roll from zero gap to any desired gap separation as permitted by structure can take place without affecting the lifter timing. In other words, the adjusting plate can be moved and positioned vertically throughout its range without developing any unwanted clearances in the idler roll lifter system.

Also the cam 47 which actuates the bracket and thus the lifter roll is exchangeable for other cams having alternate profiles. Two such cams as shown in FIG. 5 may be used and adjusted angularly to extend the duration of the lift. Easy removal and replacement of an actuating cam is made possible by the tapered member 44 keyed to shaft 35 and on which is mounted the cam member 46. The actuating cam 47 is adjustably secured to member 46 by the screws 51.

FIG. 4 shows the two secondary drive shafts 35 and 36 as extending horizontally in opposed directions, shaft 35 left and shaft 36 right, and said shafts are driven by the main shaft 30 in unison and at the same speed. Whereas shaft 35 drives the actuating cam 47 for the lifter roll 52, shaft 36 drives the shaft 63 for rotating the feed roll 62. The cam housing, within which the cam shaft 36 is journalled, includes the wall 37 and the rear wall 76 having the gear housing 77 on the rear surface thereof and which is sealed to wall 76 so as to contain oil without leaking. The cam shaft 36 is substantially journalled about mid-way of its length by spaced bearing units 78 having tapered bearings and which are located in the cartridge bearing retainer 80 having a position between the bevel gear 34 and the conjugate cams 81 and 82. The terminal end of shaft 36 is journalled by a second bearing unit 83 carried by the bearing retainer 84.

For a more detailed description of the bearing retainers 80 and 84, the conjugate cams 81 and 82 and the gear drive to the feed roll drive shaft 63, reference is made to the co-pending application of the present inventor identified by Ser. No. 655,440 filed Feb. 5, 1976 and entitled Modular Cam Driven Roll Feed.

The cams 81 and 82 drive the cam follower units 85 and 86 in an intermittent manner since the lobes on the cams have contact during each revolution of the cams with the rollers 90 and 91 of the cam follower units. The action of the lobes in first engaging and then in releasing contact with the rollers respectively, will rotate the cam follower units intermittently to thereby drive the follower shaft 92 intermittently. The cams rotate continuously and when the spherical portion of the cams is in contact with the rollers then the follower shaft 92 remains at rest. More particularly, the cams 81 and 82 will operate in a manner to rotate the cam follower shaft 92 for a feed cycle of approximately 210° for each revolution of shaft 36 and then the cam follower shaft will remain at rest for the remainder of each revolution. Other cams having different profiles can be substituted for cams 81 and 82 and thus the optional cams make possible a feed cycle from 90° through 240°.

Shaft 92 is journalled as shown in FIG. 4 at respective ends in the walls 38 and 76 by bearings 94 and beyond the right hand bearing the shaft is tapered for receiving the hub portion of the driving gear 95 which is held to the shaft by the threaded nut 96. The gear 95 is located within the gear housing 77. The housing is sealed to contain oil for lubricating the gear and for also lubricating the second driving gear 97 having meshing relation with said gear 95. Gear 97 is mounted on the feed roll drive shaft 63 which is journalled for rotation by the bearings 98 in wall 76 and by similar bearings in the intermediate wall 100. Also the right hand end of shaft 63 is tapered for receiving the hub portion of the gear 97 and which is held to the shaft by the threaded nut 101. At the left hand end of shaft 63 the same is suitably mounted for rotation by the bearing 98 in the intermediate wall 100 and the extension beyond is tapered for receiving the centrally disposed hub portion 102 of the lower feed roll 62. The threaded nut 103 is employed for securing the lower feed roll on the tapered end of the drive shaft 63.

The single jack screw 60 having the actuating handle 61 and the gibs 58 comprise the minimum parts required for the slidable adjusting plate 56. The plate supports the pivotal bracket 55 for vertical bodily movement and also has the air bag 65 mounted thereon. The idler roll 52 can be moved up and down without exhausting the air from the bag and no adjustments in the pressure exerted thereby is required. The actuating cam 47 is removable and replaceable by similar cams having different profiles and the high portion 66 of said cams has a certain angular extent and also a certain height. These control the duration of the lift and the extent of the gap opening for any adjusted position of the pivotal bracket.

It is entirely possible to remove the part 47 and employ the cam retainer 46 as the actuating cam, the same having a cam portion such as 66 formed on its peripheral surface and thus actuating the pivot arm 68 all in a manner as described. In this respect the cam retainer 46 may be considered as the primary actuating cam and 47 will comprise the secondary cam.

I claim:

1. In roll feeding apparatus of the character as described, in combination, a pair of feed rolls including a lower driven roll and an upper idler roll, frame structure providing a journalling hub portion, a drive shaft extending through the hub portion to project beyond the same and being journalled for rotation by the hub portion, an idler roll adjusting plate supported by the frame structure for slidable movement in a direction towards and from the lower driven roll, a pivotal bracket mounted on the plate, means provided by the pivotal bracket for journalling the upper idler roll and for positioning the same above and in approximate vertical alignment with the lower driven roll, and an actuating cam mounted on the projecting end of the drive shaft and having rotation with the shaft for periodically rocking the pivotal bracket to lift the upper idler roll with respect to the lower driven roll.

2. Roll feeding apparatus of the character as defined by claim 1, additionally including pressure means carried by the adjusting plate and located adjacent that end of the pivotal bracket opposite the journalled idler roll, said pressure means yieldingly biasing the pivotal bracket in a direction for contacting relation with the lower driven roll.

3. Roll feeding apparatus of the character as defined by claim 2, additionally including a pivot arm supported for pivotal movement by the hub portion, a roller on each end of the pivot arm, one roller having contact with the actuating cam and the other roller having contact with the end of the pivotal bracket adjacent the pressure means, whereby the actuating cam in rotating with the drive shaft will periodically rock the pivot arm to in turn rock the pivotal bracket in a direction for lifting the upper idler roll from the lower driven roll.

4. Roll feeding apparatus of the character as defined by claim 1, wherein the actuating cam is mounted on the drive shaft in a manner permitting angular adjustment, and additionally including threaded means in associated relation with the slidable plate for adjusting the vertical position of the plate with respect to the lower driven roll and for holding the plate in its adjusted position.

5. Roll feeding apparatus of the character as defined by claim 2, wherein the pressure means consists of an air bag.

* * * * *